United States Patent [19]

Mitchell

[11] Patent Number: 4,505,235

[45] Date of Patent: Mar. 19, 1985

[54] VALVE TIMING MECHANISMS OF INTERNAL COMBUSTION ENGINES

[75] Inventor: Stephen W. Mitchell, Bury, England

[73] Assignee: National Research Development Corporation, London, England

[21] Appl. No.: 535,556

[22] Filed: Sep. 26, 1983

Related U.S. Application Data

[63] Continuation of Ser. No. 220,856, Dec. 29, 1980, abandoned.

[30] Foreign Application Priority Data

Jan. 2, 1980 [GB] United Kingdom ..... 8000052

[51] Int. Cl.[3] ..... F01L 1/34

[52] U.S. Cl. ..... 123/90.17; 123/90.27; 123/90.31

[58] Field of Search ..... 123/90.15, 90.16, 90.17, 123/90.18, 90.39, 90.31, 90.44, 90.27; 464/69

[56] References Cited

U.S. PATENT DOCUMENTS

| | | | |
|---|---|---|---|
| Re. 30,381 | 8/1980 | Ries | 464/69 |
| 2,410,411 | 11/1946 | Gregory | 123/90.44 |
| 4,019,345 | 4/1977 | Fukuda | 464/69 |
| 4,177,773 | 12/1979 | Cribbs | 123/90.17 |
| 4,332,148 | 6/1982 | Maki et al. | 464/102 |

FOREIGN PATENT DOCUMENTS

| | | | |
|---|---|---|---|
| 2305589 | 10/1976 | France | 123/90.17 |
| 0649192 | 1/1951 | United Kingdom . | |
| 1095017 | 12/1967 | United Kingdom . | |
| 1241923 | 8/1971 | United Kingdom . | |
| 1311562 | 3/1973 | United Kingdom . | |
| 1522405 | 8/1978 | United Kingdom . | |

OTHER PUBLICATIONS

Fabian, R. J., "Variable Camshaft Boosts Engine Efficiency", *Automotive Engineering*, vol. 81, No. 12, (Dec. 1973), pp. 11–13.

*Primary Examiner*—Parshotam S. Lall
*Assistant Examiner*—W. R. Wolfe
*Attorney, Agent, or Firm*—Cushman, Darby & Cushman

[57] ABSTRACT

An internal combustion engine having at least one cylinder with inlet and exhaust valves operated via rocker arms by respective cams carried by a single camshaft. The camshaft is connected to its drive by an eccentric linkage, the eccentricity of which is varied by a device responsive to engine speed, and is least at high speed. As engine speed falls, increasing eccentricity results in a relative advance of inlet valve closing time and relative retardation of exhaust and inlet valve opening times but little change in the timing of exhaust valve closure. The lift of the valves may be varied also if the rocker arm axes are movably mounted.

23 Claims, 19 Drawing Figures

VALVE TIMING MECHANISMS OF INTERNAL COMBUSTION ENGINES

This is a continuation of application Ser. No. 220,856, filed Dec. 29, 1980, now abandoned.

The present invention relates to internal combustion engines, and in particular to variable valve timing mechanisms for such engines.

It is known that the volumeric efficiency of for example a four stroke poppet valve internal combustion engine is a function of the valve timing. An engine with a valve timing such that the inlet valve opens slightly before the piston is at the top dead centre (TDC) position and closes slightly after the piston is at the bottom dead centre (BDC) position will result in good volumetric efficiency and hence good torque characteristics at low engine speeds. In contrast, to obtain good volumetric efficiency and hence high power at high engine speeds the inlet valve should open substantially before the piston is at the TDC position and close substantially after the piston is at the BDC position.

Another problem met when considering valve timing mechanisms is that of inlet and exhaust valve overlap, that is the condition in which both the inlet and exhaust valves are open when the piston is approaching and departing from the TDC position. The reduction of this overlap at low engine speeds results in reduced exhaust emissions by preventing a proportion of the incoming air/fuel charge from mixing with the exhaust system. It is also known that retarding the opening of the exhaust valve at low engine speeds can enable more work to be obtained from the expansion stroke, thereby reducing fuel consumption, and that advancing the opening of the exhaust valve at high engine speeds can improve performance by avoiding work in scavenging the exhaust gases.

In view of the above, engines with fixed valve timing must be compromises and therefore engines with variable valve timing offer the prospect of improved performance.

British Pat. No. 1,522,405 describes a variable valve timing mechanism for an internal combustion engine including at least one valve actuating camshaft driven by a crankshaft, the mechanism comprising a member which is arranged in use to be rotatable by the crankshaft and movable in translation relative to the camshaft in dependence upon an engine operating condition, the member being connected to the camshaft by an eccentric linkage such that movement of the member relative to the camshaft varies the angular position of the camshaft about its axis of rotation relative to the angular position of the crankshaft about its axis of rotation and also varies the angular velocity of the camshaft relative to the angular velocity of the crankshaft, thereby varying the valve timing. The engine specifically described in British Pat. No. 1,522,405 comprises a separate camshaft in respect of each valve, and it will be appreciated that in a multi-cylinder engine such an arrangement is complex and requires a large number of components.

U.S. Pat. No. 4,131,096 specifically describes the same engine as British Pat. No. B 1,522,405 but in addition U.S. Pat. No. 4,131,096 also specifically describes a variable valve timing mechanism wherein one eccentric linkage can drive three camshafts each of which carries the inlet cam of one cylinder and also the exhaust cam of another cylinder in an in-line three cylinder engine with equal firing intervals. Such an arrangement cannot however be applied to a four cylinder in-line engine. Thus in the case of a conventional four cylinder in-line engine, it will be appreciated from the above described British Patent that two movable members each driving four camshafts are necessary to alter the valve timing on all the four inlet valves and all the four exhaust valves. Such an arrangement is clearly complex and, in addition, each of the movable members must be gear or chain driven from a drive situated in the centre of the engine, an arrangement which is common in motor cycle engine design but is unacceptable in car engine design as it lengthens the crankshaft and cylinder block. It has been found by actual tests on engines that the valve timing characteristics which it is most effective to vary are the positions of exhaust valve opening and inlet valve closing, the former being responsible for extending the expansion stroke at low engine speeds for fuel consumption benefits and the latter having the greatest effect on volumetric efficiency. The alteration of the inlet valve opening is also effective in as much as opening the inlet valve earlier as the engine speed increases maintains volumetric efficiency and delaying the opening at low engine speeds helps to reduce emissions. The least desirable parameter to vary is the exhaust valve closing, since delaying the exhaust valve closing as the engine speed increases has little effect on power output or fuel consumption under normal driving conditions. Also, too much alteration to the inlet valve opening and to the exhaust valve closing would not be possible if the system were to be applied to a diesel engine due to the close piston-to-valve clearances.

It is an object of the present invention to provide a potentially less complex but effective mechanism for varying valve timing, and according to the invention an internal combustion engine comprises a rotary output member driven by at least one cylinder having an inlet valve and an outlet valve and also a camshaft arrangement carrying both an inlet cam to actuate the inlet valve and also an exhaust cam to actuate the exhaust valve; the camshaft arrangement is driven by an intermediate member interposed between the camshaft arrangement and the output member such that relative movement between the intermediate member and the camshaft arrangement varies the angular position of the camshaft arrangement about its axis of rotation relative to the angular position of the rotary output member about its axis of rotation and also varies the relative angular velocity of the camshaft and the rotary output member, so varying the valve timing.

The camshaft arrangement may be so driven by the intermediate member that each revolution completed by the camshaft arrangement coincides with the completion of a constant quantity of revolution by the output member, but the relative movement between the intermediate member and the camshaft arrangement causes the rate of rotation of the camshaft arrangement within each of its revolutions to vary.

The driven rotary member may be a crankshaft, and the camshaft arrangement may comprise one camshaft carrying an inlet cam and a second camshaft carrying an exhaust cam, the two camshafts being driven from the same intermediate member and being linked to each other by gears, chain, toothed belt or the like to ensure synchronised movement. Preferably however the camshaft arrangement comprises a single camshaft carrying both inlet and exhaust valve cams.

The intermediate member may include an eccentric linkage, and the camshaft may rotate about a fixed axis and the intermediate member may include a rotor of movable and substantially parallel axis, so that movement of the axis of the rotor varies the valve timing. The axis of the intermediate member rotor may be movable in a direction substantially at right angles to the line joining its axis to that of the crankshaft.

The eccentric linkage may be of the kind in which when the linkage is operable each cycle of revolution of the camshaft comprises two parts, during one of which it is advanced relative to the crankshaft and during the other of which it is relatively retarded.

The eccentric linkage may be of crank-like type, comprising an arm pivoted at one end of the intermediate member rotor and at the other to the camshaft, and the engine may include two cylinders each with its own single camshaft, each such camshaft being driven by the same intermediate member but by way of a different eccentric linkage whereby the timing cycle of one cylinder is similar to but displaced in phase relative to that of the other.

Movement of the axis of the intermediate member rotor to vary the timing may be caused by a device responsive to an operating condition of the engine, and that operating condition may be engine speed and the responsive device may include a hydraulic ram. The responsive device may cause the axes of camshaft and intermediate member to be substantially coincident at high engine speeds, and increasingly separated as the engine speed falls, and the eccentric linkage may operate so that as the engine speed falls the increasingly eccentric drive of the camshaft results in a substantial relative advance in inlet valve closing and a substantial relative retardation in exhaust valve opening, and also perhaps in some relative retardation of inlet valve opening. However closing of the exhaust valve may coincide with a part of the eccentric cycle where angular displacement between the intermediate member rotor and the camshaft is low, whereby any eccentricity between the axes of the intermediate member rotor and the camshaft results in no more than slight change to the timing of the closure of the exhaust valve.

The engine may for instance be of conventional petrol-driven type in which the inlet valve admits petrol to the cylinder, or of fuel-injected petrol-driven type in which the inlet valve admits air to the cylinder, or of diesel type in which the inlet valve admits air to the cylinder.

The intermediate member may include a rotor rotatable about a fixed axis and the camshaft arrangement may be mounted to rotate about an axis which is substantially parallel but is movable in a radial direction, whereby such radial movement of the camshaft axis varies the valve timing. The cams may actuate their respective valves by way of rocker arms, and relative variation of position between the camshaft arrangement and the intermediate member may also serve to vary valve lift. The axes of camshaft and rocker arms may be mounted on a common movable structure, movement of which causes all these axes to execute similar radial movements.

The present invention is further described and is defined by the claims at the end of this specification, and will now be described by way of example with reference to the accompanying drawings, in which:

Figure 1:
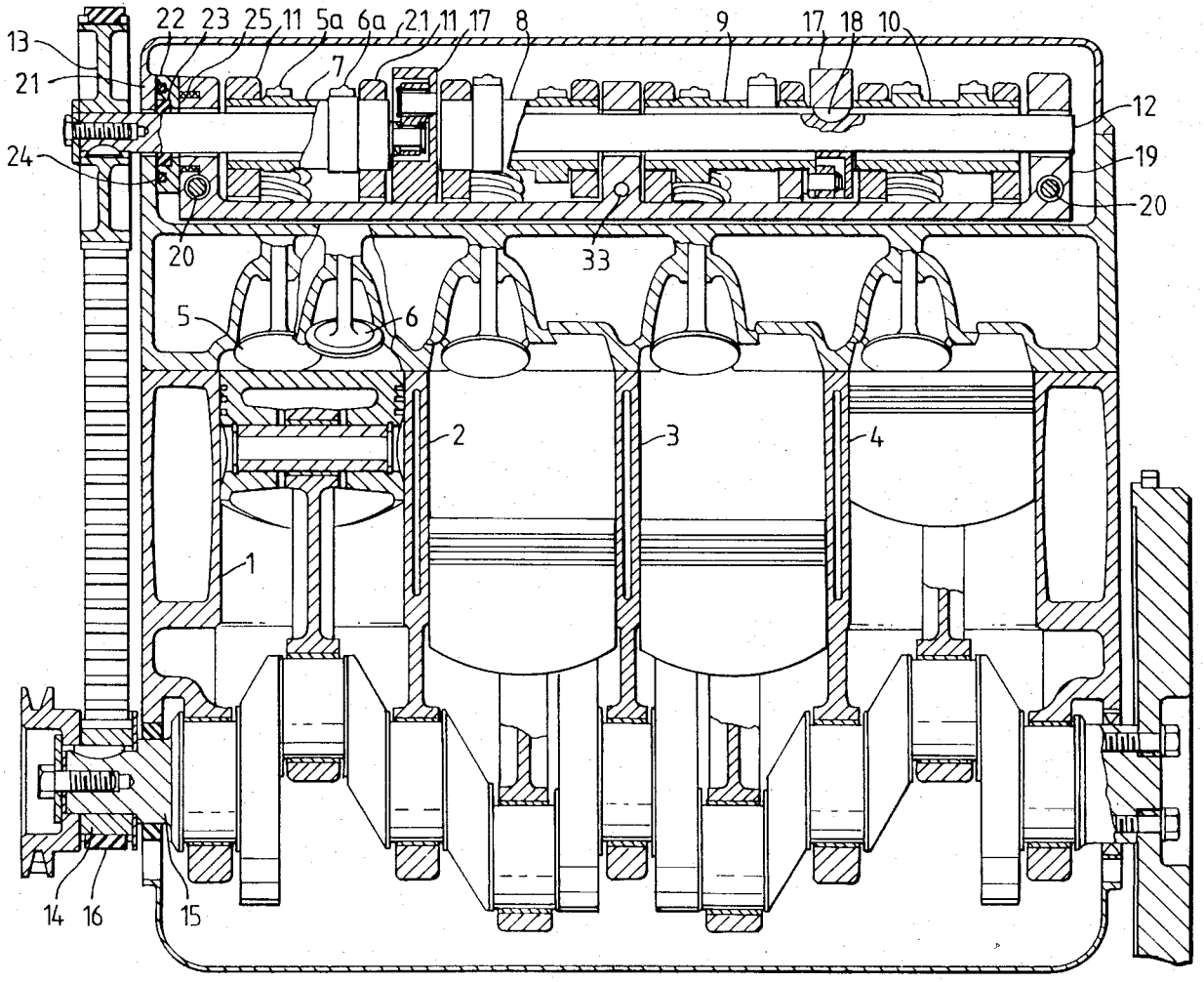
FIG. 1 is a sectional view of a four cylinder in-line engine embodying the present invention.

Referring to FIG. 1, the illustrated engine has many conventional features which it is considered do not need detailed description since they are well understood by men in the art. The engine has four cylinders 1, 2, 3 and 4, each cylinder having one inlet valve 5 and one exhaust valve 6 (the exhaust valves are not shown for cylinders 2, 3 and 4). Four in-line camshafts 7, 8, 9 and 10 are provided for cylinders 1, 2, 3 and 4 respectively, each camshaft having an inlet cam **5*a* and an exhaust cam 6*a* to control the operation of valves 5 and 6**.

Each camshaft is supported, at each end, by a fixed bearing member 11 which also supports the valve rocker spindles. Running co-axially through the camshafts 7, 8, 9 and 10 is a drive shaft 12 which is rotatably driven via pulleys 13 and 14 from a rotary output member in the form of a crankshaft 15 by a toothed drive belt 16. The drive shaft 12 passes through the centres of two intermediate members 17 each of which are rotatably driven by the drive shaft 12 by means of a key 18. One member 17 is positioned between camshafts 7 and 8 and the other member 17 is positioned between camshafts 9 and 10.

Each member 17, as well as being connected to the drive shaft 12 as already described, is also connected to the two camshafts between which it is located as will be described below with reference to FIGS. 2 and 3. The drive shaft 12 is supported in bearings attached to a member 19 which is movable on guides 20 in dependence upon an operating condition of the engine as will be apparent from the following description of FIG. 9. Since the drive shaft 12 passes through a slot in rocker cover 21, provision is made for sealing against oil leakage by a member 22 held concentric with the drive shaft 12. The member 22 has an oil seal 23 running on the drive shaft and an "O"-ring 24 which is held against the cover 21 by a spring 25 which fits into a recess in the member 19.

Figure 2:
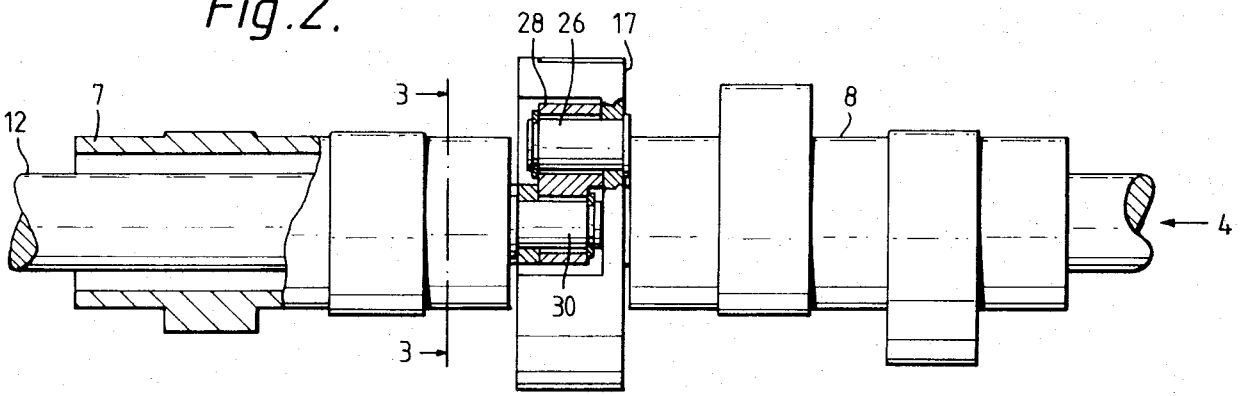
FIG. 2 is an enlarged part sectional view of the camshafts for number 1 and number 2 cylinders of the engine of FIG. 1.
Figure 3:
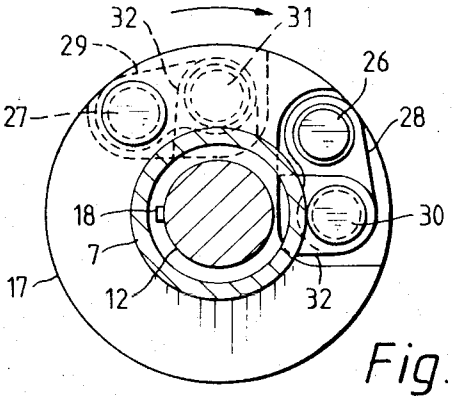
FIG. 3 is a sectional view along line 3—3 of FIG. 2.

FIGS. 2 and 3 show enlarged views, partly in section, of the camshafts 7 and 8 for cylinders 1 and 2 respectively, the member 17 located therebetween, and the connecting mechanisms between each camshaft and the member 17. FIG. 3 is a section along line 3—3 of FIG. 2 and shows the drive shaft 12 concentric with the camshafts 7 and 8. Because its bearings are mounted on the movable member 19, shaft 12 is movable transversely relative to the camshafts. Generally the eccentricity of the position of the shaft 12 relative to the camshafts will decrease as the engine speed increases to minimise wear on the interconnections therebetween, but of course if desired the eccentricity could be arranged to increase with engine speed.

Member 17 supports two identical pins 26 and 27 supporting links 28, 29 and disposed at 90 degrees to one another. Two pins 30, 31 are attached to arms 32 which form integral parts of camshafts 7 and 8 respectively. Pins 26 and 30 are connected together by the link 28 held in position upon the pins by circlips, and pins 27 and 31 are connected together likewise by the link 29 also held in position upon the pins by circlips.

The other member 17 located between camshafts 9 and 10 is likewise connected to camshafts 9 and 10 by an arrangement of pins and links, but is orientated with a different angular position, having regard to the firing order of the cylinders. The effect of the above described connecting mechanism is to provide an eccentric linkage between the drive shaft 12 and the camshafts 7, 8, 9 and 10. By moving member 19 upon its guides 20 the position of the axis of the drive shaft 12 relative to the fixed axes of the camshafts 7, 8, 9 and 10 may be varied. It will be apparent that each complete revolution of each camshaft must be matched by a complete revolution of shaft 12 and a constant quantity of revolution—usually two complete revolutions in a four-stroke engine—of crankshaft 15. However varying of the relative positions of the axes of the drive shaft 12 and the camshafts 7, 8, 9 and 10 causes the eccentric linkage, within each complete revolution of the camshafts and shaft 12, to vary the angular positions of the camshafts 7, 8, 9 and 10 about their axes of rotation relative to the angular position of the shaft 12—and hence of the crankshaft—and also to vary the angular velocities of the camshafts 7, 8, 9 and 10 relative to the steady angular velocity of shaft 12 and crankshaft 15, thereby varying the valve timing.

The movement of drive shaft 12 by member 19 (see FIG. 1) may be in dependence upon engine speed, or engine speed and load, or upon any other desired engine operating condition.

Figure 4:
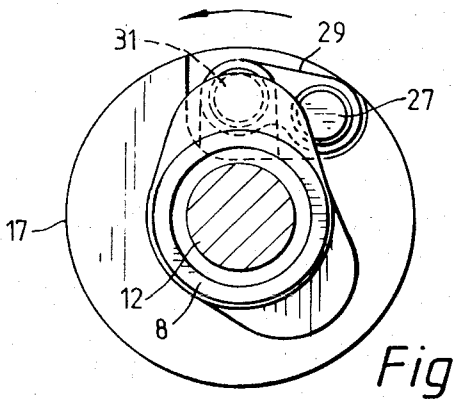
FIG. 4 is an end view in direction of arrow 4 in FIG. 2.

FIG. 4 is an end view of FIG. 2 in the direction of arrow 4 showing the inlet cam and the exhaust cam profiles on the camshaft 9.

Figure 5:
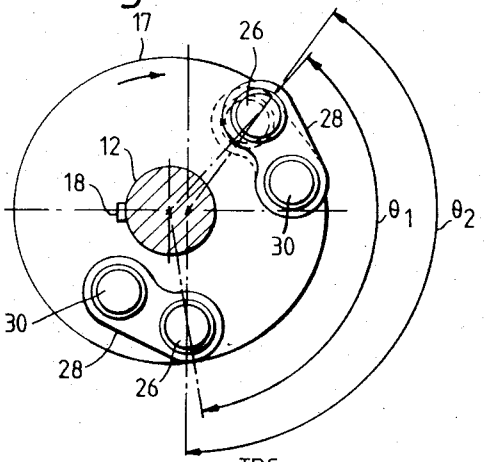
FIG. 5 shows the inlet opening and closing positions in the concentric and fully eccentric positions of the valve timing mechanism of the engine of FIG. 1.

FIG. 5 is a schematic diagram of the member 17 showing it keyed to the shaft 12. As the shaft moves from the position shown (in which it is coaxial with the camshafts) to its maximum eccentricity position, the link 28 moves from the position shown in full line to the position shown in broken line. The link 28 is shown in the inlet opening position and the inlet closing position. In the latter position, as the eccentric movement is generally perpendicular to the line joining the centres of shaft 12 and pin 26, the link 28 does not change its position with variations in the eccentricity of the shaft 12.

As the member 17 moves with the shaft 12 with respect to the camshaft 8, the angular distance travelled by the member 17 between the inlet valve opening position and the inlet valve closing position increases. $\theta_1$ represents the angular travel of the drive shaft 12 between the inlet valve opening and closing positions at maximum eccentricity and $\theta_2$ represents the angular travel of the drive shaft 12 between the inlet valve opening and closing positions at nil eccentricity. As FIG. 5 plainly shows, $\theta_2$ is substantially greater than $\theta_1$, reflecting both an advance in inlet opening and a retardation of inlet closing.

Figure 6:
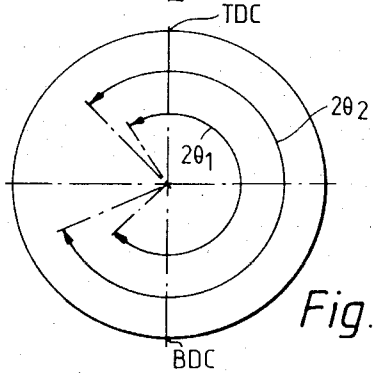
FIG. 6 shows the effect of the concentric and fully eccentric positions of the movable member on the inlet valve opening and closing expressed in crankshaft rotation.

FIG. 6 shows the effect of the variation of the period between inlet valve opening and closing expressed in terms of crankshaft rotation. Since the camshaft rotates at nominally half engine speed, the angular movement of the member 17 between the inlet valve opening and closing is doubled when shown as a function of crankshaft rotation. The reduced angular movement of the member 17 at low engine speed results in the inlet valve when operated by the camshaft not only opening later but closing earlier. That is to say, at full eccentricity the inlet valve opens nearer to the TDC position and closes nearer to the BDC position. At high engine speed, however, where the member 17 is concentric with respect to the centre of the camshafts, the increased angular movement results in the inlet valve operated by the camshaft opening substantially before the piston is at the TDC position and closing substantially after the piston is at the BDC position.

Figure 7:
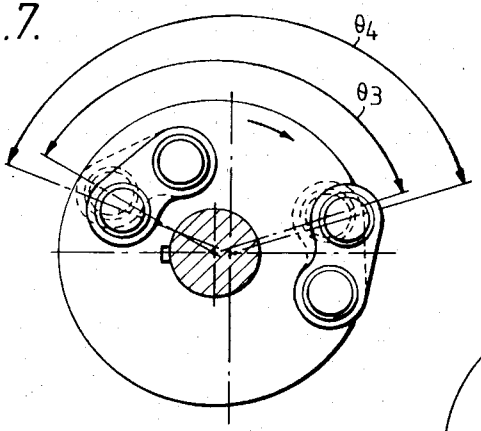
FIG. 7 shows the exhaust opening and closing positions in the concentric and fully eccentric positions of the mechanism.

FIG. 7 is a schematic diagram of the same unit as that shown in FIG. 5 but illustrates the effect of the eccentric linkage in high and low engine speed conditions upon the opening and closing of the exhaust valve. As for the inlet valve as previously described, when the member 17 moves from an eccentric position to one concentric with respect to the centre line of the camshaft, the angular distance travelled by the member 17 between the exhaust valve opening position and the exhaust valve closing position increases. $\theta_3$ represents the period between the exhaust valve opening and closing positions at low engine speed, that is to say at high eccentricity, and $\theta_4$ represents the corresponding but greater period at high engine speed when member 17 and the camshaft are concentric. It will be noted now that when the link 28 is in the exhaust closing position the line joining the centres of shaft 12 and pin 26 is nearly parallel to the direction of the eccentric movement, with the consequence that the exhaust closing time changes little, irrespective of the position of member 19 on guides 20.

Figure 8:
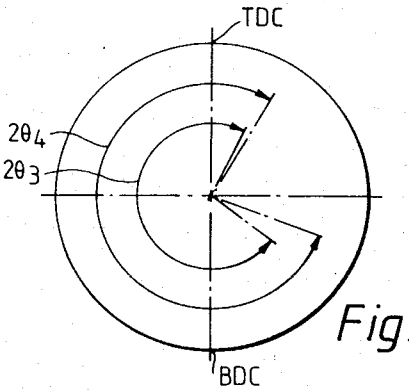
FIG. 8 shows the effect of the concentric and fully eccentric positions of the movable member on the exhaust valve opening and closing expressed in crankshaft rotation.

FIG. 8 shows the effect of the angular alteration on the exhaust valve opening and closing expressed in terms of crankshaft rotation. Again, since the camshaft rotates at nominally half engine speed, the angular movement of the member 17 between the exhaust valve opening and closing is doubled when shown as a function of crankshaft rotation. The reduced angular movement of the member 17 at low engine speed results in the exhaust valve opening later than at high engine speed. There is however no significant change in the timing of the closing of the exhaust valve, for the reason explained in the last paragraph.

It will be seen from the above that substantial alteration to the timing of inlet valve closing, and exhaust valve opening, and some alteration to the timing of inlet valve opening, has been achieved between high and low speed engine conditions without any appreciable alteration to the exhaust valve closing. Since the most effective valve timing variables in terms of engine efficiency are the positions of the inlet valve closing and the exhaust valve opening, the former having the greatest effect on volumetric efficiency and the latter being responsible for extending the expansion stroke at low engine speeds, the described embodiment of the present invention satisfies these criteria, thus providing an engine with much improved efficiency. The alteration of the inlet valve opening is also effective in improving engine operation in as much as earlier opening of the inlet valve as the engine speed increases maintains volumetric efficiency and delaying the opening of the inlet valve at low engine speeds helps to reduce emissions. Failure to vary the exhaust valve closing time materially as the engine speed increases has little detrimental effect on power output under normal operating conditions; what is more significant is that the described mechanism can be arranged to avoid any positively harmful variation of this parameter. Thus a relatively simple four-camshaft arrangement makes it possible to provide an effective variable valve timing mechanism for a four cylinder in-line engine.

It will also be appreciated from FIG. 5 and FIG. 7 that the links provided between the two members 17 and the camshafts have a very small angular movement about the pins which hold them together, so giving a low pressure-velocity factor. Therefore, in view of the fact that the maximum angular movement of the link about the pin centres occurs at minimum engine speed, a long life potential for the mechanism is ensured.

Figure 9:
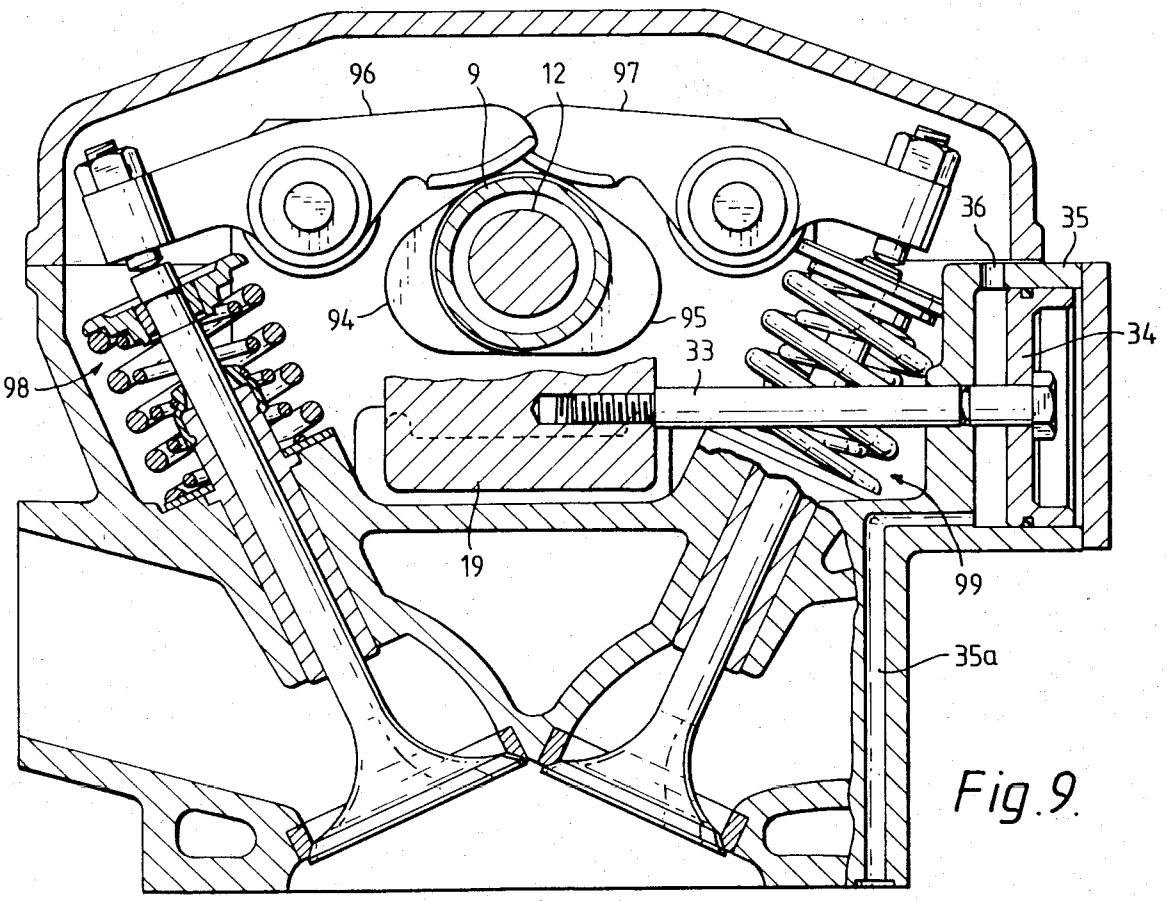
FIG. 9 is an enlarged sectional view of the cylinder head of the engine of FIG. 1 showing sections through the inlet valve, movable member drive shaft and support, movable member actuating cylinder and piston and a part-section through the exhaust port.

FIG. 9 shows an enlarged cross section through the cylinder head of the engine shown in FIG. 1 and a part cross section through an exhaust valve. It can be seen that the member 19 which is movable on guides 20 (FIG. 1) is in the high engine speed position wherein the drive shaft 12 is concentric with the camshafts. It can also be seen from FIG. 9 that the cam profiles 94 and 95, rockers 96 and 97 and valve assemblies 98, 99 all follow conventional practice.

To enable the drive shaft 12 to be movable relative to the centre of the camshafts the member 19, in which it is supported, is moved by a piston and cylinder arrangement. The member 19 is normally held in its low engine speed position—that is to say at maximum eccentricity—by springs (not shown).

The piston and cylinder arrangement comprises a piston rod 33 attached at one end to the movable member 19 and at the other to the piston 34. The position of the piston rod 33 is also shown in FIG. 1. Engine oil is fed into the cylinder 35 by way of a conduit 35*a* leading from the main oil gallery of the engine and as the engine speed is increased the resultant increase in oil pressure causes the piston 34 to move. This in turn moves the movable member 19 on its guides and alters the valve timing. The alteration of the valve timing is thus made dependent on the engine speed.

Oil pressure in the cylinder acting against the piston 34 is controlld by a slot 36 in the cylinder which is uncovered as the piston moves from the low engine speed position to the high engine speed position.

Figure 10:
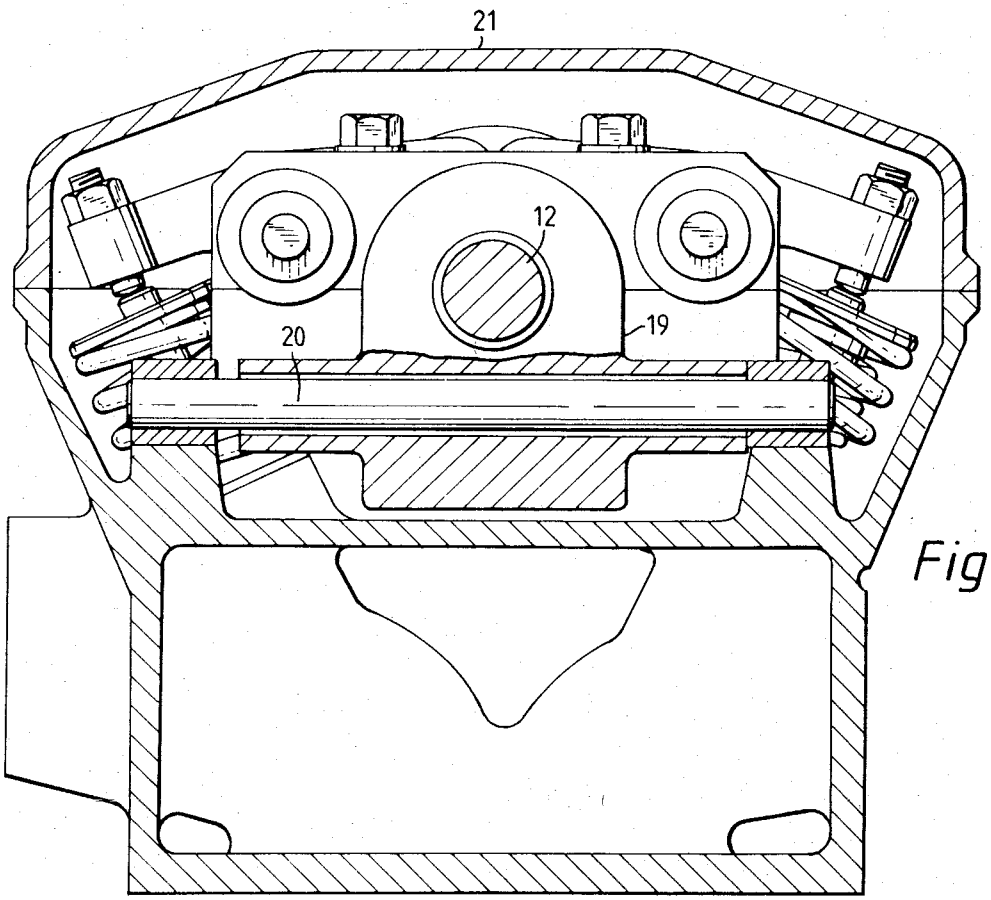
FIG. 10 is a section through the movable member support slide of the engine of FIG. 1.

The different section of FIG. 10 clearly shows the drive shaft 12 mounted upon movable member 19 which is mounted to slide along guides 20.

Figure 11:
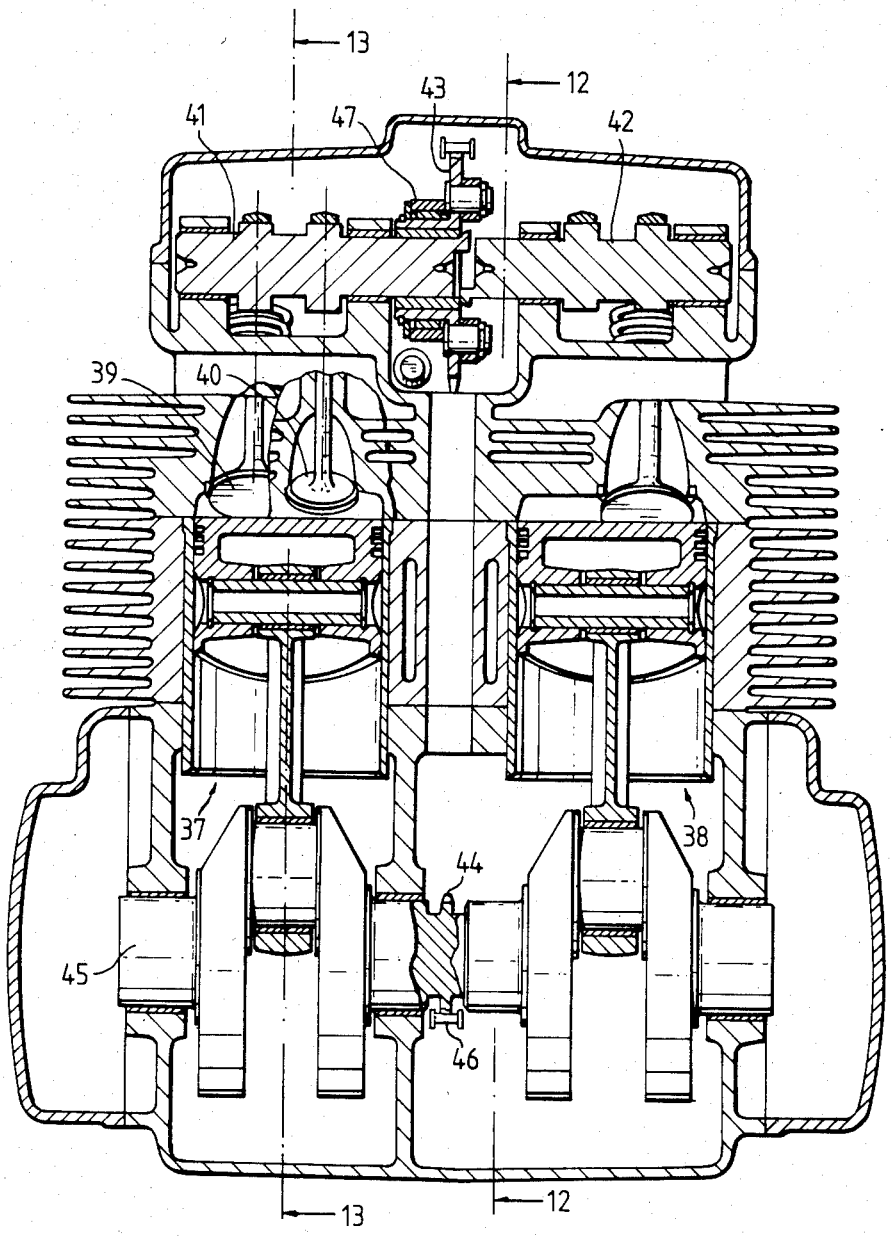
FIG. 11 is a sectional view of a twin cylinder engine embodying the present invention.

FIG. 11 shows a twin cylinder engine embodying the present invention. The engine has two cylinders 37 and 38 each having one inlet valve 39 and one exhaust valve 40. Camshafts 41 and 42 are provided for cylinders 37 and 38 respectively, each camshaft having an inlet cam and an exhaust cam. A central sprocket 43 is driven by a chain 46 from a sprocket 44 on crankshaft 45. Sprocket 43 is supported on a sliding member 47, the sliding member being movable in dependence upon an engine operating condition, and is connected to camshafts 41 and 42 by means of a connecting mechanism described with reference to FIG. 12.

Figure 12:
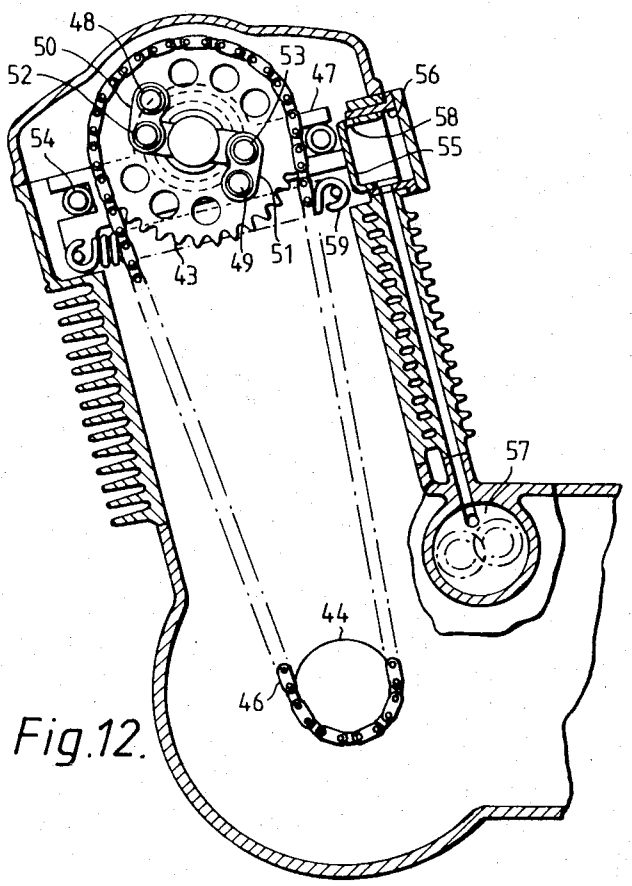
FIG. 12 is a section along line 12—12 of FIG. 11.

FIG. 12 shows the connecting mechanism between sprocket 43 and camshafts 41 and 42. The sprocket 43 supports two pins 48 and 49. A link 50 is attached to pin 48 and a link 51 is attached to pin 49. The other end of link 50 is attached by means of pin 52 to an arm which forms an integral part of camshaft 41, and the other end of link 51 is attached by means of pin 53 to an arm which forms an integral part of camshaft 42.

The sliding member 47 is supported by rollers 54 upon which it is moved, in dependence upon the engine speed, by a piston 55 in a cylinder 56. Oil is fed into the cylinder 56 from the engine oil pump 57, and as the engine speed is increased the resultant increase in oil pressure causes the piston 55 to move. The pressure in the cylinder 56 is controlled by a slot 58 which is uncovered as the piston moves from the low engine speed position to the high engine speed condition. The sliding member 47 is returned to its low engine speed position by a spring 59.

This mechanism provides between the camshafts 41 and 42 and the crankshaft 45 an eccentric linkage whose eccentricity can be varied in dependence upon engine speed. Varying the eccentricity of the eccentric linkage between camshaft and crankshaft causes the angular position of the camshafts about their axes of rotation to vary and also the angular velocities of the camshafts relative to the angular velocity of the crankshaft to vary, thereby varying the valve timing.

Figure 13:
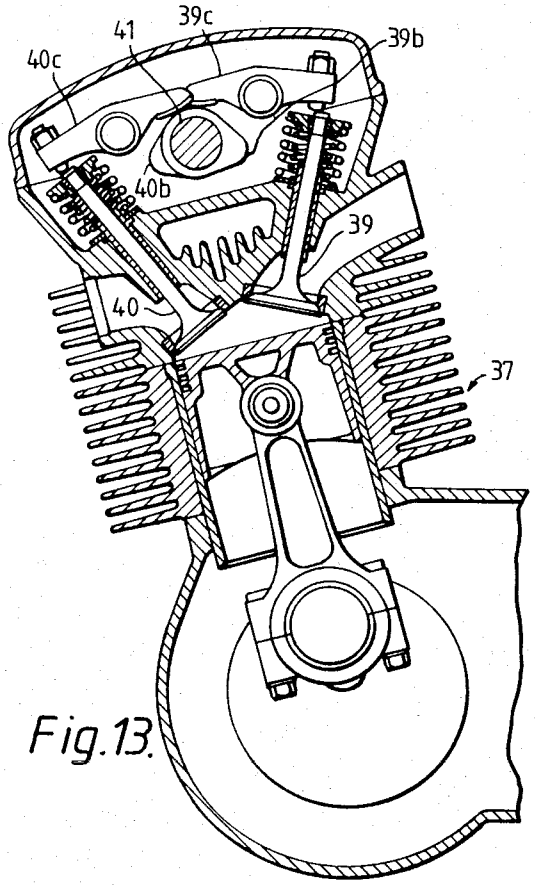
FIG. 13 is a section along line 13—13 of FIG. 11.

FIG. 13 clearly shows camshaft 41, the inlet and exhaust valves 39 and 40 and the cams 39*b* and 40*b* and rockers 39*c* and 40*c* which cause the valves to open.

Figure 14:
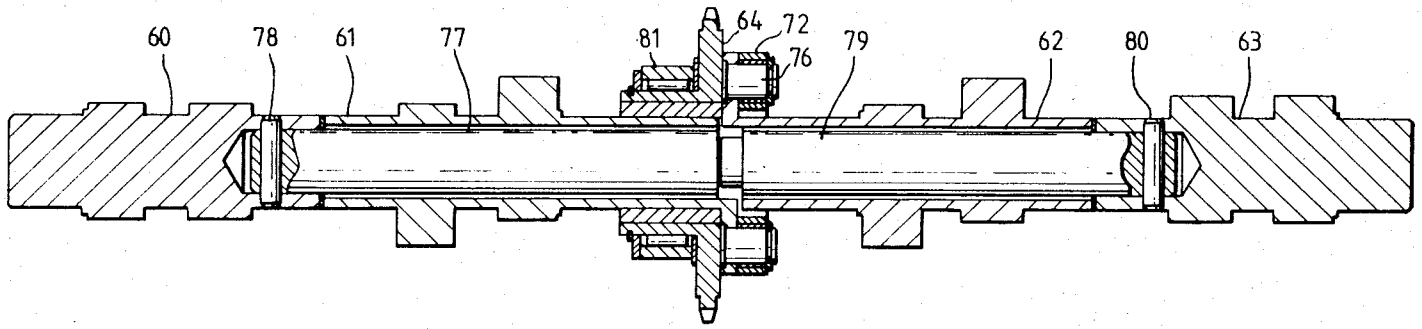
FIG. 14 is a section through a camshaft arrangement for a four cylinder in-line engine with a centre driven movable member.
Figure 16:
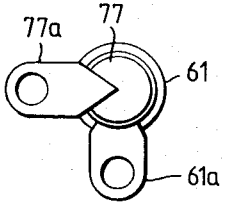
FIG. 16 is an end view on the outer camshaft drive shaft in FIG. 14.
Figure 15:
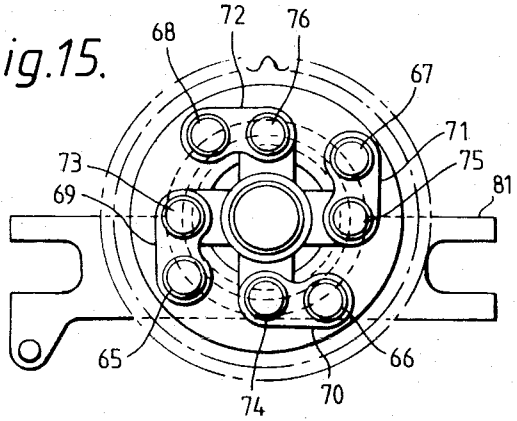
FIG. 15 is an end view on the centre driven movable member in FIG. 14.

FIGS. 14, 15 and 16 show the camshaft arrangement for a four-cylinder-in-line engine according to the invention. A sprocket 64 for driving the camshafts is located in the center. Four camshafts 60, 61, 62 and 63 each having one inlet cam and one exhaust cam are provided, one for each cylinder. The sprocket 64 supports four pins 65, 66, 67 and 68 to which are attached links 69, 70, 71 and 72 respectively. The other ends of the links 69, 70, 71 and 72 are attached to pins 73, 74, 75 and 76 respectively. Pin 73 is attached to an arm 77*a* which forms an integral part of shaft 77 which passes through the centre of camshaft 61 and drives camshaft 60 by means of a drive pin 78. Pin 74 is attached to an arm which forms an integral part of camshaft 61. Pin 75 is attached to an arm 61*a* which forms an integral part of shaft 79 which passes through the centre of camshaft 62 and drives camshaft 63 by means of a pin 80. Pin 76 is attached to an arm which is an integral part of camshaft 62. The sprocket 64 is supported in a sliding member 81 which is movable upon rollers by a piston in a cylinder and return spring arrangement generally as shown in FIG. 12.

Figure 17:
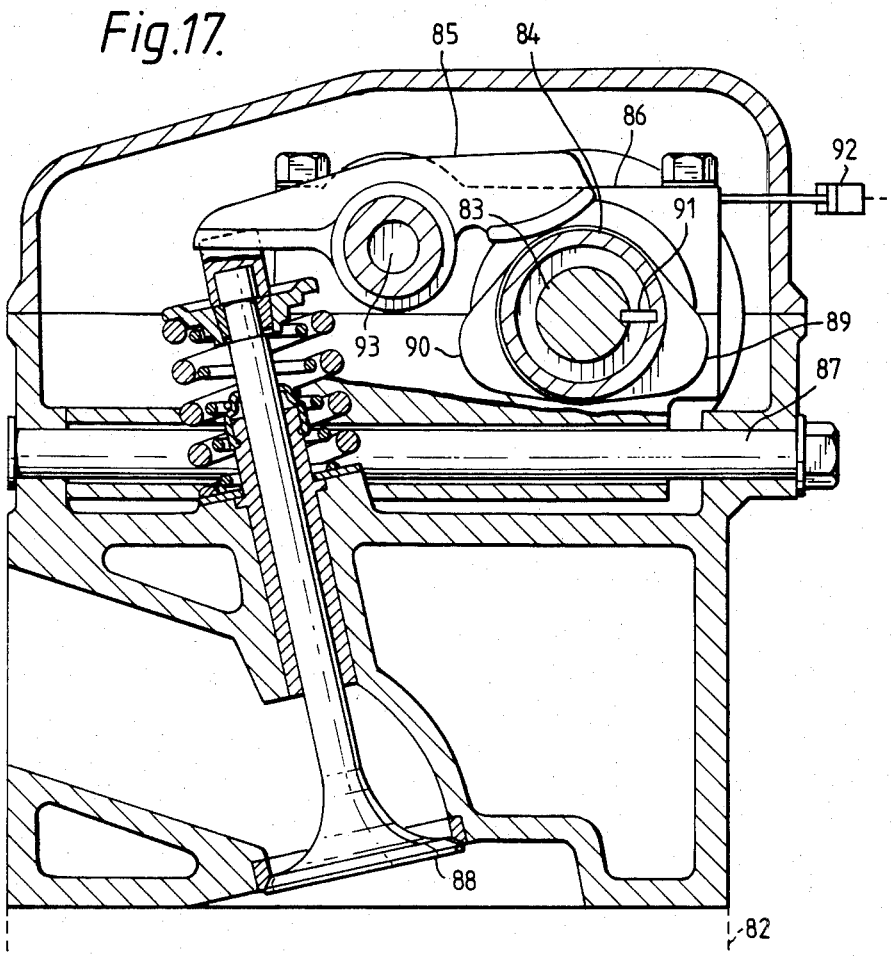
FIG. 17 is a sectional view through the cylinder head of an in line engine with in line valves but embodying a variation of the present invention which gives variable valve lift in addition to variable valve timing.
Figure 18:
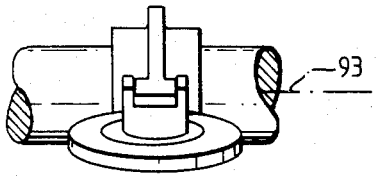
FIG. 18 is an end view of the valve cap used in FIG. 17.

FIGS. 17 and 18 show an alternative arrangement of an engine according to the present invention in which the camshafts and rockers are moved eccentrically with respect to a fixed-axis drive shaft, instead of the other way about as shown in previous Figures. The section shown in FIG. 17 shows a cylinder 82 of an in-line engine with in-line inlet (not shown) and exhaust (88) valves. The fixed-axis drive shaft 83 drives a series of camshafts, each camshaft carrying an inlet cam 89 and an exhaust cam 90 and being connected by an eccentric linkage as shown in FIGS. 1 to 10 and as indicated diagrammatically at 91 in FIG. 17. Both the movable camshaft 84 and rocker 85 shown in the section are mounted upon member 86 which slides on guides 87. Movement of the camshafts alone by a device 92 responsive to engine speed will alter the valve timing as shown in FIGS. 5, 6, 7 and 8 but by moving the rocker arm axis 93 and the camshafts together variable valve lift is also obtained.

In the embodiments of the invention shown in the drawings the inlet and exhaust valves of each cylinder have been operated by inlet and exhaust cams mounted on a single camshaft, the in-line camshafts being driven by a single in-line rotating member. However it will be appreciated that the inlet cam and the exhaust cam on each camshaft may be separated such that the inlet cams are mounted on a second set of in-line camshafts, the pair of camshafts for any one cylinder being mechanically interconnected by for example a chain drive so that they rotate in synchronism with each other. It will also be appreciated that while in the embodiments of the invention shown in the drawings the shaft 12 (FIG. 1) and sprocket 43 (FIG. 1) have been mounted to slide along straight lines under the influence of pistons 34 and 55 respectively, theoretically the illustrated drive systems (by belt 16 and chain 46) would call for such sliding movement to take place in each case along an arc concentric with the crankshaft axis. In practice, however, a belt or chain would be well able to accommodate the slight change in radius that straight-line sliding motion would require.

It will also be appreciated that while the eccentric mechanisms described in the drawings have been of the simple kind in which the driven member is advanced in phase relative to the driving member for half of each revolution, and relatively retarded for the other half, the invention also includes engines using eccentric mechanisms that cause the motions of driven and driving members to be related by more complex laws. With such eccentric mechanisms it would be possible, for instance, not simply to avoid any harmful variation of the exhaust valve closing as in the engines already described, but actually to vary this parameter beneficially in the same way as the other three parameters are varied beneficially in the engines that have been described. Such variation of exhaust valve closing could be beneficial because the exhaust valve closing could for instance be advanced at low engine speed to prevent too much exhaust gas flowing back into the cylinder particularly at low throttle openings, leading to incomplete combustion on the next stroke and increasing unburnt hydrocarbons.

Figure 19:
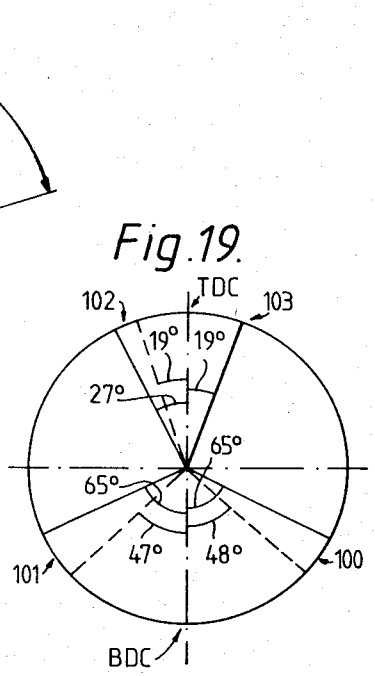
FIG. 19 is a timing diagram of an engine in which the profiles of inlet and exhaust cams are different.

FIG. 19, which may conveniently be studied alongside FIGS. 5 to 8, is a conventional engine timing diagram illustrating a typical range of timing variation that use of the present invention may make possible in a typical four-stroke engine. The radii in full lines indicate the timing of the engine at high speed while the radii in broken lines indicate the timing at low engine speed. The engine is of the kind in which, in the absence of a variable timing facility, exhaust valve opening 100 would be set at 65° before bottom-dead-centre and inlet valve closing 101 would be set at 65° after BDC, and inlet valve opening 102 and exhaust valve closing 103 would be set respectively at 19° before and after top-dead-centre. Using the present invention, inlet valve closing 101 may be advanced from 65° to 47° after BDC as engine speed falls, thus increasing low engine speed torque, and exhaust opening 100 may be retarded by an almost equal angle, say from 65° to 48° before BDC, thus increasing torque in fuel consumption remains unaltered or alternatively allowing a reduction in fuel consumption without loss of torque. Such simultaneous alteration to inlet closing 101 and exhaust opening 100 as a function of engine speed thus gives the prospect of substantial improvements in power and in fuel consumption. As to inlet opening 102, by using an inlet cam different in shape to the exhaust cam it may be arranged that opening occurs at 27° before TDC at high engine speed, so permitting improved engine "breathing", but occurs at the more customary 19° before TDC at low engine speed. There is however no substantial variation of the timing of exhaust valve closing 103, which remains at 19° after TDC at all times.

I claim:

1. An internal combustion engine comprising: a rotary output member; at least one cylinder driving that output member; an inlet valve and exhaust valve for each cylinder; a single camshaft arrangement carrying both an inlet cam to operate said inlet valve and an exhaust cam to operate said exhaust valve, said camshaft arrangement being rotatable and including means constraining said inlet cam and said exhaust cam to rotate at the same speed at all times; driving connection means between said camshaft arrangement and said rotary output member for effecting rotation of said camshaft such that each complete revolution of the camshaft corresponds to a constant quantity of revolution of said rotary output member, said driving connection means being operable to vary, within each complete revolution of said camshaft, the angular position of the camshaft about its axis of rotation relative to the angular position of said rotary output member and to vary the angular velocity of said rotary output member to thereby vary the valve timing, said driving connection means including at least one rotatable intermediate member, a moving mounting for at least one of said intermediate member and said camshaft arrangement whereby movement of said movable mounting varies the radial distance of said cams from the axis of said rotation of said intermediate member, said variation of said radial distance causing said variation of the timing of said valves; and a device responsive to the engine speed of said engine to impart said movement to said mounting.

2. An internal combustion engine according to claim 1 in which said intermediate member includes a rotor rotatable about a fixed axis; said inlet and exhaust cams actuate their respective valves by way of rotatable rocker arms; there is a common movable structure on which the axes of said camshaft arrangement and said rocker arms are mounted, and said movement of said structure relative to the said fixed axis of said rotor of said intermediate member is adapted to vary both the said timing and the lift of said valves of said engine.

3. An internal combustion engine as in claim 1 wherein the construction and arrangement of said driving connection means is such that, as engine speed falls, there is substantial advance of inlet valve closing time, substantial retard of exhaust valve opening time, with little change in inlet valve opening time and still less change in exhaust valve closing time.

4. An internal combustion engine comprising a rotary output member;

at least one cylinder driving that output member;

an inlet valve and exhaust valve for each cylinder;

a single rotary camshaft arrangement carrying both an inlet cam to operate said inlet valve and an exhaust cam to operate said exhaust valve;

connection means connecting said inlet cam and said exhaust cam, said connection means being adapted to cause said inlet cam and said exhaust cam to rotate at the same speed at all times;

a cyclic phase-change coupling between said camshaft arrangement and said rotary output member, said coupling being operable to cause said rotary output member and said camshaft arrangement to rotate at equal cyclic speeds but with continual variation of phase angle within each cycle;

said coupling including at least one rotatable intermediate member mounted so that its axis of said rotation is movable radially relative to the axis of rotation of said camshaft arrangement, said radial movement determining the magnitude of said variation of phase angle within each cycle of rotation of said camshaft arrangement relative to each corresponding cycle of constant angular velocity of said rotary output member, such variation of phase angle altering the relative timing of said inlet and exhaust valves, and a device responsive to engine speed of said engine and operative to impart said radial movement to said intermediate member.

5. An internal combustion engine according to claim 4 of conventional petrol-driven type in which said inlet valve admits petrol to said cylinder.

6. An internal combustion engine according to claim 4 of fuel-injected petrol-driven type in which said inlet valve admits air to said cylinder.

7. An internal combustion engine according to claim 4 of diesel type in which said inlet valve admits air to said cylinder.

8. An internal combustion engine according to claim 4 in which said intermediate member includes a rotor rotatable about a fixed axis and said camshaft arrangement is mounted to rotate about an axis which is substantially parallel but is movable in a radial direction, and in which such said radial movement of said camshaft arrangement axis varies said valve timing.

9. An internal combustion engine according to claim 4 in which said rotational output member is a crankshaft.

10. An internal combustion engine according to claim 9 in which said camshaft arrangement comprises a first camshaft carrying said inlet cam and a second camshaft carrying said exhaust cam, said first and second camshafts being connected by said connection means which comprise drive means such as gears or toothed belt ensuring synchronised movement and being driven by a single said intermediate member.

11. An internal combustion engine according to claim 4 in which an endless drive member connects said crankshaft to said intermediate member.

12. An internal combustion engine according to claim 9 in which said camshaft arrangement comprises a single camshaft carrying both said inlet cam and said exhaust cam, said single camshaft thus constituting said connection means.

13. An internal combustion engine according to claim 12 in which said inlet and exhaust cams actuate their respective valves by way of rocker arms, and in which relative variation of position between camshaft arrangement and the intermediate member is also adapted to vary the lift of said valves.

14. An internal combustion engine according to claim 12 in which said intermediate member includes an eccentric linkage.

15. An internal combustion engine according to claim 14 including two cylinders each with its own single camshaft, each said single camshaft being driven by the same said intermediate member but by way of a different said eccentric linkage whereby the timing cycle of one said cylinder is similar to but displaced in phase relative to that of the other said cylinder.

16. An internal combustion engine according to claim 14 in which said single camshaft rotates about a fixed axis and said intermediate member includes a rotor of movable and substantially parallel axis, and in which movement of said axis of said rotor varies said timing of said valves.

17. An internal combustion engine according to claim 16 in which said axis of said intermediate member rotor is movable in a direction substantially at right angles to the line joining its axis to that of said crankshaft.

18. An internal combustion engine according to claim 16 in which said eccentric linkage is of the kind in which when said linkage is operable each cycle of revolution of said camshaft comprises two parts, during one of which it is advanced relative to said crankshaft and during the other of which it is relatively retarded.

19. An internal combustion engine according to claim 18 in which said eccentric linkage is of crank-like type, comprising an arm pivoted at one end to said intermediate member rotor and at the other to said camshaft.

20. An internal combustion engine according to claim 16 in which said responsive device causes said axes of said camshaft and said intermediate member to be substantially coincident at high engine speed, and to be increasingly separated as the engine speed falls.

21. An internal combustion engine according to claim 20 in which said eccentric linkage operates so that as said engine speed falls the increasingly eccentric drive of said camshaft results in a substantial relative advance in closing of said inlet valve and substantial relative retardation in opening of said exhaust valve.

22. An internal combustion engine according to claim 20 in which increasing separation of the axes of said camshaft and said intermediate member from a fall in said engine speed results also in some relative retardation of opening of said inlet valve.

23. An internal combustion engine according to claim 20 in which said eccentric linkage operates so that closing of said exhaust valve coincides with a part of the eccentric cycle where angular displacement between said intermediate member rotor and said camshaft is low, whereby any eccentricity between the axes of said intermediate member rotor and said camshaft results in no more than a slight change to the timing of the closure of said exhaust valve.

* * * * *